US005966844A

United States Patent [19]

Hellerman et al.

[11] Patent Number: 5,966,844

[45] Date of Patent: Oct. 19, 1999

[54] SHORT, WIDE, LIGHT WEIGHT PORTABLE SKI APPARATUS FOR ATTACHMENT TO A SNOWSHOE

[76] Inventors: Steven A. Hellerman, 866 9th St., Boulder; Jeremy P. Verne, 2521 Glencoe St., Denver, both of Colo. 80207

[21] Appl. No.: 09/137,482

[22] Filed: Aug. 20, 1998

Related U.S. Application Data

[60] Provisional application No. 60/056,215, Aug. 21, 1997.

[51] Int. Cl.[6] ..... A43B 5/04; A43B 5/16; A63C 11/00

[52] U.S. Cl. ..... 36/122; 280/809; 36/46

[58] Field of Search ..... 36/122–125, 116; 280/809, 600

[56] References Cited

U.S. PATENT DOCUMENTS

| | | | |
|---|---|---|---|
| D. 205,186 | 7/1966 | Koskela et al. | 36/122 X |
| 2,410,702 | 11/1946 | Arsenault | 36/100 |
| 3,600,829 | 8/1971 | LaViolette | 36/122 |
| 3,861,698 | 1/1975 | Greig | 280/603 |
| 4,004,355 | 1/1977 | Koblick | 36/122 |
| 4,334,369 | 6/1982 | Brunel | 36/124 |
| 4,836,571 | 6/1989 | Corbisiero | 36/97 X |
| 5,398,957 | 3/1995 | Leighton et al. | 36/122 X |
| 5,553,403 | 9/1996 | McManus | 36/124 |
| 5,884,933 | 3/1999 | Trott | 280/603 |

FOREIGN PATENT DOCUMENTS

| | | | |
|---|---|---|---|
| 37183 | 8/1906 | Switzerland | 36/122 |

*Primary Examiner*—B. Dayoan

*Attorney, Agent, or Firm*—Donald W. Margolis; Emery L. Tracy

[57] ABSTRACT

A ski apparatus for attachment to a snowshoe is provided, the apparatus having a main ski body having a top surface and a bottom surface. The main ski body supports a snowshoe entirely above the ground. A securing mechanism secures a snowshoe closely adjacent the top surface of the main ski body.

18 Claims, 2 Drawing Sheets

SHORT, WIDE, LIGHT WEIGHT PORTABLE SKI APPARATUS FOR ATTACHMENT TO A SNOWSHOE

RELATED U.S. APPLICATION DATA

This application claims the benefit of, and is a continuation in part of U.S. Provisional Application Ser. No. 60/056,215 filed on Aug. 21, 1997, and also entitled SHORT, WIDE, LIGHTWEIGHT PORTABLE SKI APPARATUS FOR ATTACHMENT TO A SNOWSHOE.

BACKGROUND OF THE INVENTION

1. Field of the Invention

This invention relates generally to skiing and snowboarding apparatus, and more particularly, it relates to skiing and snowboarding apparatus which is quickly attachable to and detachable from a snowshoe.

2. Description of the Prior Art

Today, more than ever, people are concerned with their health and overall wellbeing. Many people have chosen to achieve good health by exercising in outdoor environments. Every year participation in outdoor activities continues to increase, with people seeking new ways to exercise outdoors. In other instances, people find it necessary to travel off of the beaten path in snowy environments, and must usually chose a single means of conveyance, i.e. short snowshoes or long cross country skis.

Snowshoeing activities have traditionally been a proven healthful activity which provides hours of enjoyment and exercise when traversing through snowy environments. Unfortunately, while offering tremendous practical travel or exercise opportunities when traveling in a generally level or uphill direction, snowshoeing, as compared to skiing, can be slow and inefficient when traveling down hill. Moreover, snowshoeing can be extremely difficult when traveling down steep hills. During snowshoeing activities, oftentimes it becomes desirable to have a better and faster method of traveling downhill.

While a variety of "short" skis have been developed for clamping onto boots and for providing a sliding surface much shorter than standard length skis, prior to the present invention none of the known skis provide a snowshoe user with a simple and effective way of traveling downhill. For example, Arsenault, U.S. Pat. No. 2,410,702 describes a combination that can be quickly transformed from a ski into a snowshoe and then back to a ski. In the Arsenault patent, the ski has permanently hinged side wings which may be lowered to convert the ski into a snowshoe, and which can be raised to resume the ski function. Unfortunately, the ski/snowshoe combination of the Arsenault patent does not allow the user to remove the ski during snowshoeing activities, thereby potentially causing dangerous and uncomfortable interference with the normal use of the snowshoe.

In other known prior art, Swiss Patent 37,183 teaches a short ski with a snowshoe mounted upon it. U.S. Pat. Nos. Des. 205,186; 3,600,829 and 3,861,698 teach devices which combine the function of a snowshoe and ski. U.S. Pat. Nos. 4,004,355; 4,334,369 and 5,398,957 teach strap-on skis for regular shoes. A separate ski which is attachable to and detachable from a snowshoe is not known to exist in the prior art.

With the needs defined above, and in view of the limitations of the prior art in mind, the objects of the present invention will become apparent to those skilled in the art from the following detailed description, showing the contemplated novel construction, combination, and elements as herein described, it being understood that changes in the precise embodiments and equivalents to the herein disclosed invention are meant to be included as coming within the scope of the claims, except insofar as they may be precluded by the prior art.

SUMMARY OF THE INVENTION

The present invention is a ski apparatus for attachment to a snowshoe. The apparatus comprises a main body having a top surface and a bottom surface with the main body supporting the snowshoe entirely above the ground. Securing means secure the snowshoe closely adjacent the top surface of the main body.

In an embodiment of the present invention, the main body has a toe end and a heel end with the securing means including a first strapping assembly closely adjacent the toe end of the main body and a second strapping assembly closely adjacent the heel end of the main body. Preferably, the first strapping system and the second strapping system are adjustable to tighten about the snowshoe. Furthermore, preferably, the first strapping system has a first strap and a second strap with the first strap being releasably connectable to the second strap, and, preferably, the second strapping system has a third strap and a fourth strap with the third strap being releasably connectable to the fourth strap.

Preferably, the securing means include step-in type quick-release bindings. Furthermore, preferably, the bindings include a plurality of U-shaped receiving channels.

In another embodiment of the present invention, the main body has a toe portion, the toe portion of the main body having an upward curved attitude.

In still another embodiment of the present invention, the main body is constructed from a cold-resistant polymeric plastic material. Preferably, the main body is flexible and durable.

In yet another embodiment of the present invention, the main body has a toe end and a heel end, and further comprising at least one longitudinal rib extending along the bottom surface of the main body from a point substantially adjacent the toe end of the main body to a point substantially adjacent the heel end of the main body. Preferably, the main body has three ribs.

In still yet another embodiment of the present invention, the main body has a first side edge and a second side edge, and further comprising distribution means for distributing the weight of a user to the first and second side edges. Preferably, the distribution means includes a raised cap mounted on the top surface of the main body along the first side edge and the second side edge. Furthermore, preferably, the raised cap is constructed from a resilient material securely mounted on the top surface of the main body.

In another embodiment of the present invention, the ski apparatus further comprising edging material mounted around a perimeter of the main body. Preferably, the edging material includes a strong, rigid metal material.

In still another embodiment of the present invention, the main body has a substantially parabolic profile.

The present invention further includes a method for attaching a snowshoe to a ski apparatus. The method comprises providing a main body having a toe end, a heel end, a first side edge, a second side edge, a top surface, and a bottom surface and securing the snowshoe closely adjacent the top surface of the main body thereby supporting the snowshoe entirely above the ground.

In an embodiment of the present invention, the method further comprises curving the toe portion of the main body in an upward attitude.

BRIEF DESCRIPTION OF THE DRAWINGS

The accompanying drawings illustrate complete preferred embodiments of the present invention according to the best modes presently devised for the practical application of the principles thereof, and in which.

DETAILED DESCRIPTION OF THE PREFERRED EMBODIMENTS

Figure 1:
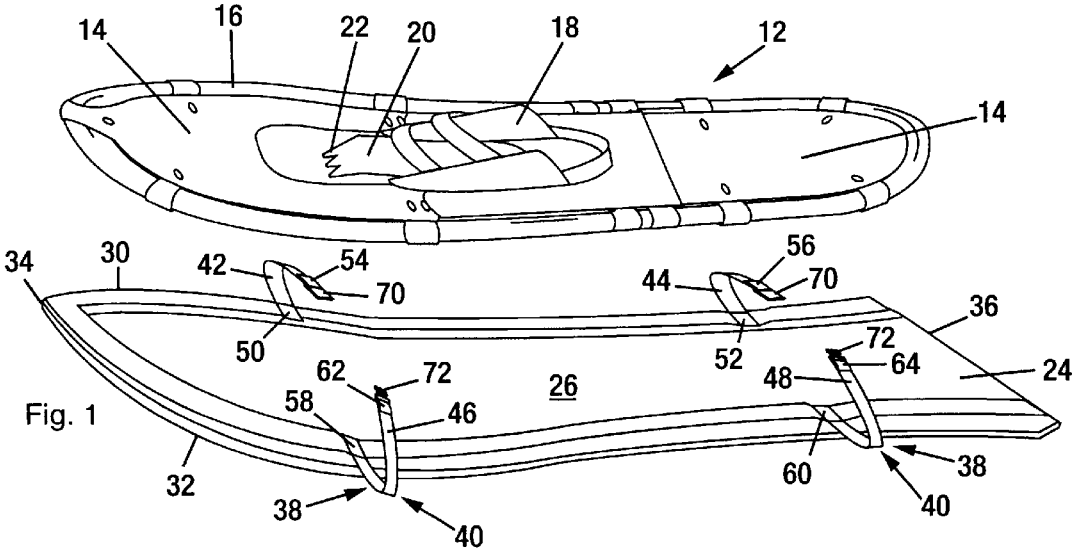
FIG. 1 is a top perspective view of the ski apparatus according to the present invention illustrated in exploded relationship to a standard snowshoe.
Figure 2:
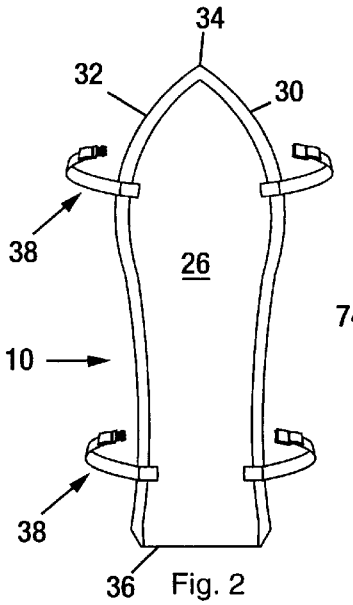
FIG. 2 is a top plan view of the ski apparatus according to the present invention illustrating the mechanism for attaching the ski to a snowshoe, and other elements of the upper surface of the ski.

As illustrated in FIGS. 1–4, short, wide, light weight portable ski apparatus, indicated generally at 10, is designed for attachment to any standard snowshoe 12. Typically, snowshoe 12 includes a surface to bear against the snow, such as membrane 14, tubular outer frame 16 surrounding and supporting snow bearing surface 14. Membrane 14 may be formed from any strong, preferably flexible material, including carbon fiber. Snow bearing surface 14 may also be formed of other art known materials and structures, such as woven webbing. Snowshoe 12 also includes a boot securing device, generally 18, within snow bearing membrane surface 14 for securing a boot, not shown, of a snowshoer, also not shown, to snowshoe 12. As shown, most snowshoes 12 include a pair of crampons, with a first crampon 20 positioned at what will be the toe of the snowshoer and a second crampon, not shown, being positioned at what will be the heel of the foot of the snowshoer. Crampons are well known in the art, and typically include tooth-like gripping elements 22 which provide the snowshoer improved traction while snowshoeing.

The new and improved short, wide, light weight portable ski apparatus 10, of the present invention is designed for attachment to a snowshoe 12. Portable ski apparatus 10 has a short, wide main body 24 which is sized and designed to carry the entire body of conventional snowshoe 12 thereon, preferably without any portion of the snowshoe 12, extending beyond the outer dimensions of main body 24 of ski 10. However, it is within the scope of the present invention to have ski apparatus 10 which has a main body 24 with outer dimensions less than or greater than the outer dimensions of the snowshoe 12, so long as ski 10 is capable of suspending the entire body of snowshoe 12 above the snow or ground.

Figure 3:
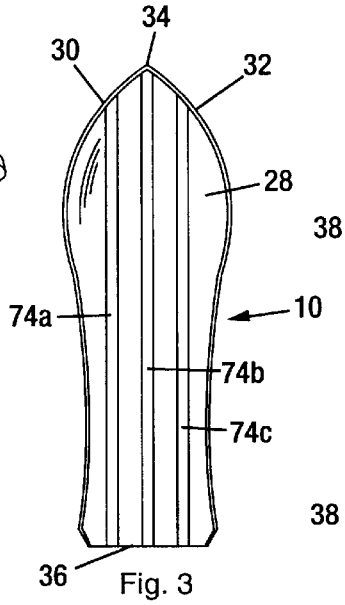
FIG. 3 is a bottom plan view of the ski apparatus according to the present invention, and showing a plurality of ribs formed thereon.
Figure 4:
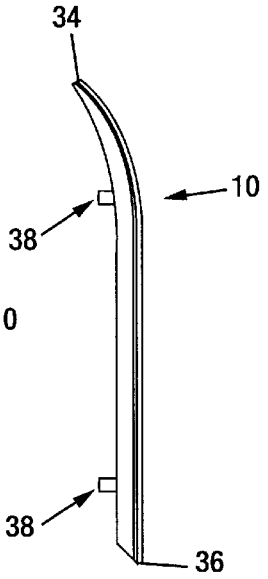
FIG. 4 is a right side plan view of the ski apparatus according to the present invention, the left side plan view being a mirror image thereof.

The main body 24 of ski apparatus 10 has a top surface 26, a bottom surface 28 opposite top surface 26 (as illustrated in FIG. 3), a first side edge 30 along the left longitudinal length of main body 24, a second side edge 32 along the right longitudinal length of main body 24 opposite the first side edge 30, a tip 34, and a top rear edge 36 opposite tip 34. In this embodiment tip 34 and the adjacent top front portion of the main body 26 is formed, preferably during manufacture in upward curved attitude, such as is typical in conventional snowboards and downhill and cross country skis. Main body 24 is preferably constructed from a cold-resistant plastic material which is flexible and durable of the type which is currently used for conventional skiing uses. However, main body 24 may be constructed from other suitable materials including, but not limited to, fiberglass, metal, wood, laminated materials and the like.

Top surface 26 of main body 24 of ski apparatus 10 includes binding devices, generally 38, for attaching ski assembly 10 of the present invention to snowshoe 12. In the preferred embodiment, and as shown in greater detail in FIG. 5B, binding devices 38 include an adjustable first and second strap assembly 40. Each of the first and second strap assemblies 40 includes first strap members 42, 44, respectively, and second strap members 46, 48, respectively. First strap members 42, 44 each have a first strap end 50, 52, respectively, and a second strap end 54, 56, respectively. Similarly, second strap members 46, 48 each have a first strap end 58, 60, respectively, and a second strap end 62, 64, respectively. The first strap end 50, 52 of first strap member 42, 44, respectively, of first and second strap assemblies 40 are preferably mounted to the top surface 26 of the main body 24 adjacent the first side edge 30. First strap end 58, 60 of second strap member 46, 48, respectively, of first and second strap assemblies 40 are preferably mounted to the top surface 26 of main body 24 adjacent the second side edge 32. The mounting of first strap ends 50, 52, 58, 60 to top surface 26 of main body 24 is preferably accomplished by using bolts 68, as shown in phantom in FIGS. 5A and 5B. However, other conventional mechanical or chemical means may be used to mount first strap ends 50, 52, 58, 60 to top surface 26 of main body 24, such as, but not limited to clamps, screws, rivets, welds, adhesive, resolve, or the like equivalent connecting means. While not shown, in preferred embodiments sets of spaced apart receiving holes may be preformed in the snowshoe ski, for example by drilling, to receive mechanical snowshoe securing device at different locations for different sized or contoured snowshoes.

The second strap end 54, 56 of first strap member 42, 44, respectively, and second strap end 62, 64 of second strap member 46, 48, respectively, have a conventional clip assembly 66 for releasably attaching the second strap end 54, 56 of the first strap member 42, 44, respectively, to the second strap end 62, 64 of the second strap member 46,48, respectively. For instance, in preferred embodiments, second strap end 54, 56 of first strap member 42, 44, respectively, includes a female clip portion 70 and second strap end 62, 64 of second strap member 46, 48, respectively, includes a male clip portion 72, of the kind known in the art. The female clip portion 70 matingly receives the male clip portion 72 thereby releasably securing first strap member 40, 42 to second strap member 44, 46, respectively. Both the female clip portion 70 and male clip portion 72 may include standard art known mechanisms for slidingly receiving at least a portion of either of first strap members 42, 44 and second strap members 46, 48, respectively, thereby allowing the length of first strap members 42, 44 or second strap member 46, 48 to be adjusted as desired.

Figure 5A:
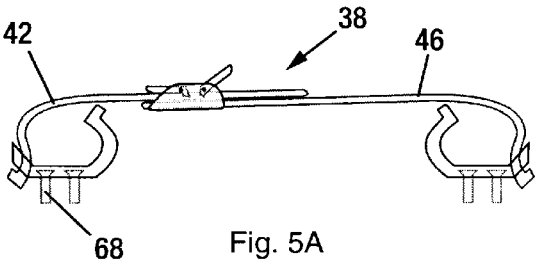
FIGS. 5A and 5B are enlarged detailed views of a first and second preferred type of strap binding for attaching the ski to a snowshoe.
Figure 5B:
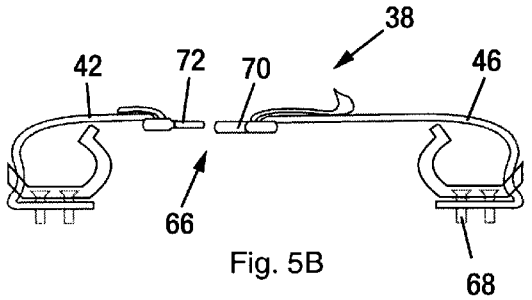

Another preferred embodiment for connecting first strap members 42, 44 to second strap members 46, 48 using buckles is shown in FIG. 5A. Other attachment methods for connecting first strap members 42, 44 to second strap members 46, 48 including, but not limited to, snaps, hook and loop fasteners, buttons, buckles and the like equivalent means are within the scope of the present invention. First strap members 42, 44 to second strap members 46, 48 may be constructed of, but are not limited to, nylon straps, elastomeric straps, leather straps, plastic straps and similar state-of-the-art and equivalent bindings. The actual attachment of snowshoe 12 to ski apparatus 10 in the practice of the present invention are discussed in further detail below.

In one preferred embodiment of the present invention, as shown in FIG. 3, bottom surface 28 of the main body 24 further includes one or more longitudinal rib 74 extending along the length of bottom surface 28 from a point substantially adjacent front edges 30 and 32 and tip 34 to a point substantially adjacent bottom rear edge 36. Ribs 74 assist the user to maintain control of ski assembly 10 while skiing by maintaining the intended travel direction of ski apparatus 10. However, it should be understood that the presence or absence of such ribs is completely optional.

In the preferred embodiment, bottom surface 28 of the main body 24 of the ski apparatus 10 has three ribs 74*a*, 74*b* and 74*c*, with ribs 74*a* and 74*b* being substantially adjacent the bottom side edges, and rib 74*c* in the center of bottom surface 28. Each of the ribs 74*a*, 74*b* and 74*c* preferably has a width of about 1 inch and a thickness of about 0.375 inch, although ribs 74*a*, 74*b* and 74*c* may have greater or lesser lengths, widths or thicknesses.

Figure 11:
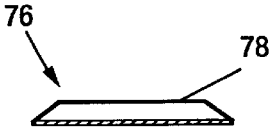
FIG. 11 is a cross-sectional view of the ski apparatus of FIG. 6 taken at 11-11 of FIG. 7.

Now referring to FIGS. 6–9, yet other embodiments and modifications of the short, wide, light weight portable ski apparatus 10 are shown. In these embodiments and modifications like parts have like numbers. In this preferred embodiment, the top surface 26 of ski assembly 10 of the present invention further includes a mechanism 76 to distribute the weight of the user out to the first and second side edges 30, 32 and through to the edges on bottom surface 28 of main body 24 of ski assembly 10, thereby providing the user better control of the ski assembly 10 during skiing activity. The preferred weight distribution mechanism 76, as shown in additional cross-sectional detail in FIG. 11 comprises a raised cap 78, preferably of resilient material securely mounted on top surface 26 along the first side edge 30 and the second side edge 32. While the weight distribution mechanism 76 has been described as being constructed of a resilient material, other materials including, but not limited to, non-resilient materials are within the scope of the present invention. In preferred embodiments weight distribution mechanism 76 is of sufficient height such that placement of snowshoe 12 upon weight distribution mechanism 76 supports the bottom surface 28 of snowshoe 12, including crampon 20 if present, above the top surface 26 of the main body 24 of ski assembly 10 with little, if any, contact between bottom surface 28 or the crampon and top surface 26. In the preferred embodiment best shown in FIGS. 6 and 7, cap 78 has a plurality of apertures or indentations 80 and 82 formed at what will be approximately the toe and heel of the user. Apertures or indentations 80 and 82 are designed to receive the crampons of snowshoe 12 without exerting stress or damaging pressure on cap 78. As noted above, cap 78 allows the weight of the user to be distributed to first and second side edges 30, 32, and therethrough to main body 24 of ski assembly 10 to allow better control over ski assembly 10 during skiing activity, as described in additional detail below. Cap 78 may be mounted on top surface 26 of ski assembly 10 by conventional means such as nuts and bolts, screws, rivets, welds, adhesives, and the like.

Figure 6:
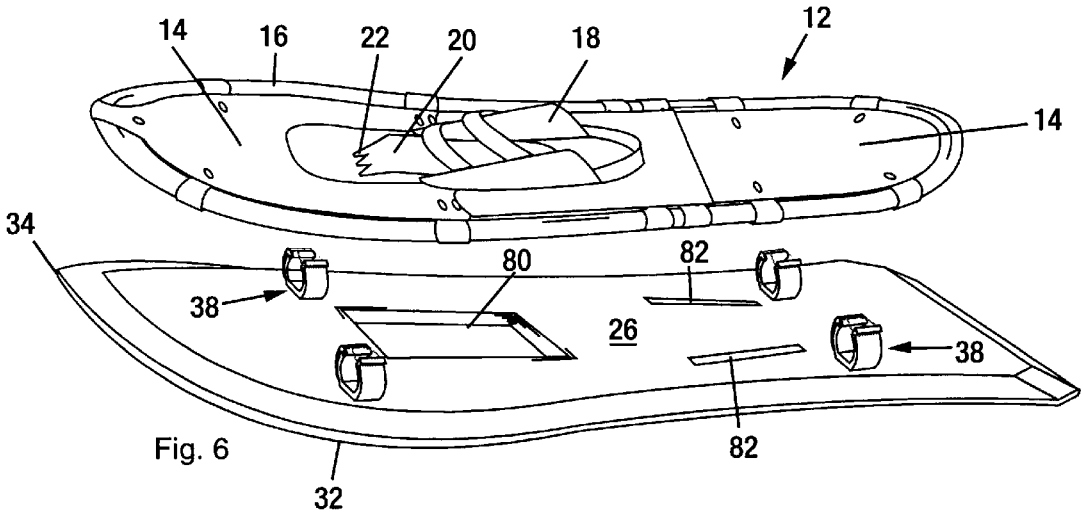
FIG. 6 is a top perspective view of a second embodiment of the ski apparatus according to the present invention illustrated in exploded relationship to a standard snowshoe.
Figure 7:
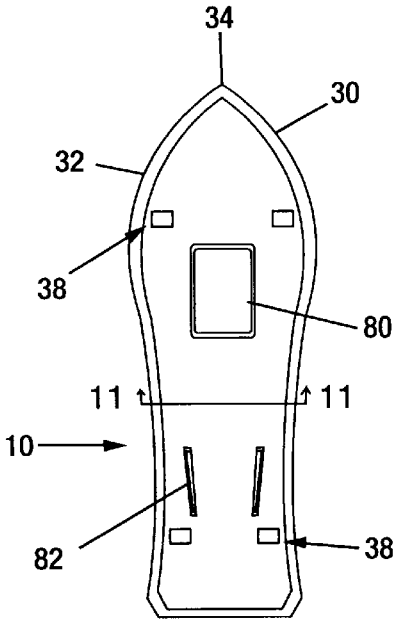
FIG. 7 is a top plan view of the ski apparatus of FIG. 6 according to the present invention illustrating the mechanism for attaching the ski to a snowshoe, and other elements of the upper surface of the ski.
Figure 8:
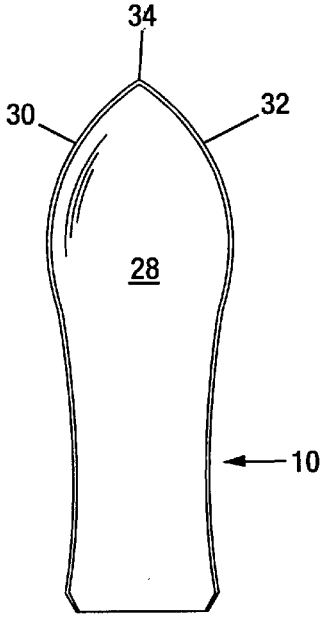
FIG. 8 is a bottom plan view of the ski apparatus of FIG. 6 according to the present invention.
Figure 9:
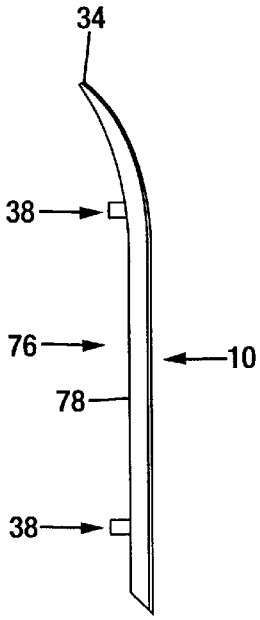
FIG. 9 is a right side plan view of the ski apparatus of FIG. 6 according to the present invention, the left side plan view being a mirror image thereof.
Figure 10A:
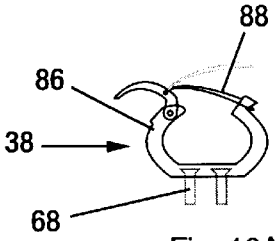
FIGS. 10A and 10B are enlarged detailed views of a first and second preferred type of step-in type quick-release bindings for attaching the ski to a snowshoe, shown in open and closed positions, respectively.
Figure 10B:
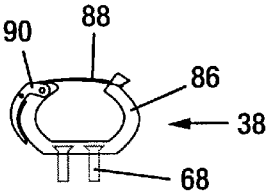

An additional modification to the present invention, as best shown in FIGS. 6 and 7, and 10B includes step-in type quick-release bindings, generally 86. The binding illustrated in FIG. 10B includes a U-shaped receiving channel. The channel is generally dimensioned to have a width which is about equal to or slightly greater than tubular outer frame 16 of snowshoe 12, and is preferably curved inward at the top to provide a degree of mechanical gripping to frame 16 after it is inserted in a channel, as described below. Quick-release bindings 86 also include a top latching mechanism, such as closure 88 which may be connected from the left side of the channel to the right side, and then tensioned into a locked position after tubular outer frame 16 of snowshoe 12, not shown, is placed in the channel by pivoting toggle 90, as illustrated in FIG. 10B. An alternative quick-release binding mechanism, is illustrated in FIG. 10A Control of skis during traverses and stops on the snow or ice is very important for both safety and enjoyment in conventional skiing activities. To this end, many conventional skis are provided with an edge material which has been sharpened. Sharp edges provide the skier with the ability to "cut" into a snowy or icy slope in order to maintain control. In ski assembly 10 of the present invention, the bottom surface 28 of main body 26 includes bottom side edges 30, 32 and 36 which have been so sharpened. Preferably, the edging material 30, 32 and 36 is comprised of a strong, rigid metal material which can be periodically sharpened to form a sharp edge. It should be noted, however, that edges 30, 32 and 36 may be formed from other equivalent art known materials.

Furthermore, first side edge 30 and second side edge 32 have a substantially parabolic profile. The parabolic profile of the first and second side edges 30, 32 allow the entire first and second side edges 30 and 32 to contact the snow surface at the times that the user makes turns with the ski assembly 10, thereby providing improved control of the ski assembly 10 during use.

Ski assembly 10 of the present invention provides an innovative and unique assembly which allows a snowshoer to easily, quickly, and safely traverse in an intended downhill direction without having to remove or otherwise unduly manipulate the conventional snowshoe upon the boot of the user. The user can easily carry a pair of ski assemblies 10 of the present invention, one for each boot, on his or her back or in his or her backpack and, when he or she has snowshoed to a place where there is a downhill slope, attach ski assemblies 10 to bottoms of his or her snowshoes 12 and ski down the slope in a conventional manner. At such a time or position during snowshoeing in the presence of a downhill slope, the snowshoer simply removes ski assemblies 10 from his or her back or backpack and places each ski assembly 10 on top of the snow adjacent each snowshoe 12. The snowshoer then, while maintaining snowshoes 12 on his or her feet, places snowshoes 12 on the top surface 26 of the main body 24 of one ski assembly 10. When using the embodiment of FIGS. 6–9 and 11, the weight distribution mechanism 76 will then evenly distribute the weight of the user to the first and second bottom side edges 30 and 32 of each of the ski assemblies 10. Finally, in the embodiment of FIGS. 1–4 strap assembly 38 is releasably secured over snowshoe 12 in front of the user's boot and the second strap assembly 40 is releasably secured over the snowshoe 12 behind the user's boot, thereby securing snowshoe 12 to ski assembly 10. Similarly, in the embodiment of FIGS. 6–9 and 11, step-in quick-release bindings 84 are releasably secured to tubular outer frame 16 thereby in this manner securing snowshoe 12 to ski assembly 10. When the need for ski assemblies 10 is passed, those processes are reversed.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the description, except as precluded by the prior art. Moreover, the invention as disclosed herein, may be suitably practiced in the absence of the specific elements which are disclosed herein.

We claim:

1. A ski apparatus for attachment to a snowshoe, the apparatus comprising:

a main ski body having a toe end, a heel end opposed to said toe end, a first side edge, a second side edge opposed to said first side edge, a top surface, and a bottom surface, said main ski body designed and adapted to hold and support a snowshoe which is placed on said top surface entirely above the ground, and wherein said toe, heel and said first and second side edges defining the perimeter of said main ski body; and securing means for securing a snowshoe which is placed on said top surface closely adjacent said top surface of said main ski body, to thereby support such a snowshoe entirely above the ground.

2. The apparatus of claim 1 wherein said securing means including a first strapping system closely adjacent to said toe end of said main ski body and a second strapping system closely adjacent to said heel end of said main ski body, said first strapping system and said second strapping system being designed and adapted to tighten about a snowshoe placed on said top surface of said main ski body to thereby support such a snowshoe entirely above the ground.

3. The apparatus of claim 2 wherein said first strapping system has a first strap adjacent to said first side edge, and a second strap adjacent to said second side edge, said first strap being releasably connectable to said second strap about a snowshoe placed on said top surface of said main ski body, and further wherein said second strapping system has a third strap adjacent to said first side edge, and a fourth strap adjacent to said second side edge, said third strap being releasably connectable to said fourth strap about a snowshoe placed on said top surface of said main ski body.

4. The apparatus of claim 1 wherein said securing means includes step-in type quick-release bindings releasably connectable to a snowshoe placed on said top surface of said main ski body.

5. The apparatus of claim 4 wherein said bindings include a plurality of U-shaped channels adjacent to said first and second side edges for releasably connecting a snowshoe placed on said top surface of said main ski body.

6. The apparatus of claim 1 wherein said toe portion of said main ski body has an upward curved attitude.

7. The apparatus of claim 1 wherein said main ski body is flexible and durable, and is constructed from a cold-resistant polymeric material.

8. The apparatus of claim 1 wherein said main ski body further comprises at least one longitudinal rib extending along said bottom surface from a point substantially adjacent said toe end of said main ski body to a point substantially adjacent said heel end of said main ski body.

9. The apparatus of claim 8 wherein said main ski body has a plurality of such ribs.

10. The apparatus of claim 1 wherein said main ski body further comprises distribution means for distributing the weight of a user of snowshoes placed on said top surface of said main ski body to said first and second side edges of said main ski body.

11. The apparatus of claim 10 wherein said distribution means includes a raised cap mounted on said top surface of said main ski body along said first side edge and said second side edge of said main ski body.

12. The apparatus of claim 11 wherein said raised cap is constructed from a resilient material secured on said top surface of said main ski body to hold and support a snowshoe above said top surface of said main ski body.

13. The apparatus of claim 12 wherein said distribution means further includes a plurality of indentations formed closely adjacent said toe end and closely adjacent said heel end in order to receive any crampons carried by a snowshoe without exerting stress or damaging pressure on said distribution means.

14. The apparatus of claim 1 and further comprising strong, rigid edging material mounted around said perimeter of said main ski body.

15. The apparatus of claim 14 wherein said edging material is metal.

16. The apparatus of claim 1 wherein said main ski body has a substantially parabolic profile.

17. A method for attaching a snowshoe to a ski apparatus, the method comprising:

providing a main ski body having a toe end, a heel end, a first side edge, a second side edge, a top surface, and a bottom surface;

providing securing means for securing a snowshoe which is placed on said top surface of said ski; and then securing a snowshoe closely adjacent said top surface of said main ski body thereby supporting such a snowshoe entirely above the ground.

18. In a device for traversing in a downhill direction, the improvement comprising:

a snowshoe having a supporting surface contactable with the ground;

a ski having a top surface and a bottom surface; and means for releasably securing said snowshoe to said top surface of said ski, said supporting surface of said snowshoe being supported entirely above the ground.

* * * * *